US005976042A

United States Patent [19]

LaMarche et al.

[11] Patent Number: 5,976,042

[45] Date of Patent: Nov. 2, 1999

[54] HOCKEY PUCK WITH CENTRALLY DISPOSED SPHERICAL ELEMENT

[76] Inventors: Paul LaMarche, 1034 Meadowcrest Dr., Waterford, Mich. 48327; Gregory J. Thompson, 782 Briarwood St.; James E. Smith, Rte. 7, Box 145, both of Morgantown, W. Va. 26505

[21] Appl. No.: 08/974,133

[22] Filed: Nov. 19, 1997

[51] Int. Cl.[6] ..... A63B 71/02

[52] U.S. Cl. ..... 473/588

[58] Field of Search ..... 473/588, 589

[56] References Cited

U.S. PATENT DOCUMENTS

| | | | |
|---|---|---|---|
| 2,444,810 | 7/1948 | Creasy | 473/588 |
| 2,454,492 | 11/1948 | Turnbull | 473/588 X |
| 2,812,184 | 11/1957 | McGee | 473/588 X |
| 3,201,128 | 8/1965 | Palovik | 473/588 X |
| 3,206,210 | 9/1965 | Bard | 473/588 |
| 3,726,526 | 4/1973 | Randovich | 473/588 |
| 3,767,200 | 10/1973 | Lohr | 473/588 X |
| 3,997,164 | 12/1976 | White, Sr. . | |
| 4,078,801 | 3/1978 | White, Sr. . | |
| 4,111,419 | 9/1978 | Pellegrino . | |
| 4,153,253 | 5/1979 | White, Sr. . | |
| 4,754,973 | 7/1988 | Kunick . | |
| 4,793,769 | 12/1988 | Dolan . | |
| 4,801,144 | 1/1989 | De Masi, Jr. et al. . | |
| 5,014,990 | 5/1991 | Kaser et al. | 473/588 |
| 5,149,096 | 9/1992 | Keating et al. . | |
| 5,184,820 | 2/1993 | Keating et al. . | |
| 5,240,251 | 8/1993 | Filice . | |
| 5,269,520 | 12/1993 | Vellines . | |
| 5,275,410 | 1/1994 | Bellehumeur et al. . | |
| 5,284,343 | 2/1994 | Bigornia et al. . | |
| 5,288,072 | 2/1994 | Hsieh . | |
| 5,346,214 | 9/1994 | Bruhm . | |
| 5,348,298 | 9/1994 | Montogomery . | |
| 5,366,219 | 11/1994 | Salcer et al. . | |
| 5,429,360 | 7/1995 | Capecci, Jr. . | |
| 5,465,966 | 11/1995 | La Savio . | |
| 5,472,193 | 12/1995 | Everman . | |
| 5,482,274 | 1/1996 | Bellehumeur . | |
| 5,516,098 | 5/1996 | Aiello . | |
| 5,518,237 | 5/1996 | Bellehumeur . | |
| 5,518,238 | 5/1996 | Hu et al. . | |
| 5,531,442 | 7/1996 | Gill . | |
| 5,568,923 | 10/1996 | Kahn et al. . | |
| 5,733,213 | 3/1998 | Colarusso | 473/588 |

*Primary Examiner*—Raleigh W. Chiu
*Attorney, Agent, or Firm*—Arnold B. Silverman; Michael D. Lazzara; Eckert Seamans Cherin & Mellott, LLC

[57] ABSTRACT

A hockey puck has a generally cylindrical body having an upper face, a lower face and a circumferential wall with a generally spherical puck element secured centrally within the body and being rotatable with respect to the puck body. In a preferred embodiment, the generally spherical puck element has a weight greater than that of the body and a diameter greater than the distance between the upper face and lower face. The generally spherical puck element is secured within an inner member which in turn has a ring disposed radially outwardly thereof and secured to the inner member. The puck is structurally designed to have the generally spherical puck element have translational and rotational kinetic energy while the body will have translational or translational and rotational kinetic energy. This results an enhanced ability to maintain the puck on the desired path despite roughness of the surface on which it is moving or certain types of impact with other objects.

17 Claims, 6 Drawing Sheets

HOCKEY PUCK WITH CENTRALLY DISPOSED SPHERICAL ELEMENT

BACKGROUND OF THE INVENTION

1. Field of the Invention

The present invention relates to an improved hockey puck which is adapted to move more truly on the designated path despite irregularities in the surface over which it is moving and, more specifically, it is designed to have mechanically interacting components which, as a result of relative degrees of freedom of movement and mass distribution, as well as dimensions, facilitate true movement responsive to impact.

2. Description of the Prior Art

It has been known in connection with the game of ice hockey to use a hard rubber puck which preferably is chilled immediately prior to use and has a height substantially less than the diameter. Similar pucks as well as hollow resinous pucks and even hollow balls have been used in connection with hockey played on surfaces other than ice. See U.S. Pat. No. 5,516,098.

As employed herein, the term "ice hockey puck" shall refer to any puck which is intended to be used in playing the game of ice hockey or practicing the same on natural, non-uniform ice, such as ponds, lakes, streams and rivers or man-made ice.

As employed herein, the term "hockey puck" shall mean "ice hockey pucks," as well as pucks intended for use on surfaces other than ice, such as those employed in street hockey, playground hockey, indoor hockey and other generally cylindrical pucks adapted for use on surfaces other than ice. The term "non-ice hockey pucks" shall mean a hockey puck designed for use on surfaces other than ice.

It is characteristic of the traditional hockey pucks that in use what was once the upper surface may become the lower surface as the puck is flipped over during play or dropped to initiate play as in a face-off. Also, such pucks may, on occasion, roll on their circumferential wall.

An ideal hockey puck slides across the ice or other surface in a designated path which is generally a straight line. In some instances, skilled players intentionally cause the puck to move in a curved path. As a result of irregularities in the path, such as the build-up of ice or the creation of recesses in the ice as a result of players on ice skates, as well as cracks or other irregularities on non-ice surfaces, a conventional puck may have a tendency to be diverted from its intended path. This is partially attributable to the nature of the surface, the contact between the puck and the ice or other support surface and due to the fact that the puck is a continuous generally cylindrical object.

If a conventional puck hits an obstruction at a position other than the puck's center of gravity a moment is created thereby causing the puck to translate and/or rotate away from the intended path. Such impact can also cause it to roll on edge.

When a conventional puck is hit with a hockey stick and the puck is subjected to responsive movement, the puck may contain purely translational kinetic energy, purely rotational kinetic energy or a combination of both rotational kinetic energy and translational kinetic energy. In most situations, it is only the translational movement in a generally straight line that is desired, which means that only translational kinetic energy is desired. There may, in some instances, be situations where a skilled player may intentionally effect rotation so as to apply spin or "English" which would aid in establishing a non-linear motion to avoid an obstacle, such as another player.

In conventional pucks which have substantially uniform distribution of mass and a generally rigid body the dissipation of kinetic energy can occur from friction between the puck and the underlying surface over which it is moving. This frictional retardation can be reduced by choosing to make the puck of a different material or design. For example, the puck can contact the underlying surface on the entire face or at only discrete locations on the face with the latter serving to minimize the contact area and thereby minimize dissipation of energy through friction. Also, dissipation of energy can occur when the puck hits an obstruction, such as another hockey stick, a player, the dasher boards from a generally perpendicular direction or portions of the goal. The amount of energy transferred from the puck to the obstruction is a function of the mass of the puck and the obstruction, the velocity of the puck and the angle of impact between the puck and obstruction.

Numerous means have been known to attempt to reduce the adverse effect of irregularities in the underlying surface and friction between the puck and the underlying surface. It has been known in connection with a street hockey puck to provide puck faces which are concave so as to have only the outer periphery of the puck touch the underlying ground. One known puck of this type is that designated the Mylek Lazer Puk. It has also been known to attempt to minimize the contact through the use of multiple knobs or spheres around the periphery of the puck faces.

It has been known to provide a puck design which has a hollow cavity within which is disposed a metal disk in order to resist the pucks rolling on edge. See, for example, U.S. Pat. No. 5,275,410. It has also been known to suggest the use of a puck having three or four sphere-like surfaces projecting from a face thereof. Such pucks have been known under the trade designation Sun Hockey. One of the problems with pucks with multiple spheres, such as the Sun Hockey Puck, is they tend to collect dirt in the socket housing the spheres, thus, creating resistance to rolling movement of the spheres. U.S. Pat. No. 5,149,096 discloses an ice hockey puck having projections which are said to enhance stability and reduce the snow plowing effect. See, also, U.S. Pat. No. 5,531,442 which discloses three balls projecting from both sides of the puck.

U.S. Pat. No. 4,111,419 discloses the use of a plurality of headed pins on the periphery of a practice hockey puck which is tethered to a hockey stick. See, also, U.S. Pat. No. 5,346,214 which discloses a hard rubber puck having knob-like protrusions on the puck faces to facilitate smooth movement on the ice. See, also, U.S. Pat. No. 5,288,072 and U.S. Pat. No. 5,482,274, as well as U.S. Pat. No. 5,184,820 which is said to have projections which reduce the coefficient of friction.

It has been known to suggest a practice hockey puck wherein the weight of the puck may be altered by providing removable material inside the puck. See, U.S. Pat. No. 5,284,343.

U.S. Pat. No. 4,801,144 discloses a puck having three spherical balls which project from both faces of the puck.

U.S. Pat. No. 5,518,237 discloses a hockey puck composed of a polymer and being of generally ring-shape with a central web and containing a filler material. This is said to facilitate riding over a rough surface with a minimized tendency to turn over completely or turn on its side.

U.S. Pat. No. 5,366,219 discloses a puck having ground-engaging runners projecting from the opposed faces to minimize contact with the surface over which the puck is passing. See, also U.S. Pat. No. 5,568,923 which relates to a roller hockey puck and has a plurality of roller wheel assemblies projecting therefrom and U.S. Pat. No. 5,518,238 which has a plurality of roller members.

U.S. Pat. No. 4,153,253 also discloses the concept of introducing weights into the puck interior.

U.S. Pat. No. 4,754,973 discloses a puck of alternating harder and softer materials so as to minimize injury as a result of a player being hit by a puck. See, also, U.S. Pat. No. 5,275,410.

U.S. Pat. No. 5,240,251 discloses puck faces which are composed of a special material for use on hard non-ice surfaces.

U.S. Pat. No. 5,269,520 discloses alternating disks which are so assembled and configurated as to be said to resist the tendency to bounce or flip over during use. U.S. Pat. No. 5,465,966 discloses a puck having surface disks on its faces so as to reduce the tendency of the puck to roll.

U.S. Pat. No. 4,078,801 discloses a street hockey puck wherein an internal weight is provided within a puck body composed from an assembly of components.

U.S. Pat. No. 3,997,164 is made from an assembly of components including a resilient member which is said to resist injury due to impact with the puck.

U.S. Pat. No. 5,348,298 discloses a combination roller ball and puck. The interior chamber is adapted to be filled with a powder-like material when desired.

U.S. Pat. No. 5,472,193 is said to provide a gyroscopically stabilized hockey puck. This puck has a hub which is mounted through appropriate bearings to establish relative rotation with respect to the face plates. The outer peripheral surface projects beyond the face plates so the puck can tilt without tripping on the surface.

U.S. Pat. No. 5,429,360 discloses a street hockey puck consisting a toroidal core formed of rigid steel surrounded by a helically wound outer sidewall structure composed of spring steel rod.

In spite of the foregoing disclosures, there remains a very real and substantial need for an improved puck which will facilitate effective, accurate sustained translational movement of the puck and resistance to departure from the desired path of travel as a result of irregularities in the surface over which it travels or contact with other objects including players.

SUMMARY OF THE INVENTION

The present invention has met the above-described needs.

The hockey puck of the present invention has a generally cylindrical body having an upper face, a lower face and a circumferential wall. A generally spherical puck element is disposed centrally within the body and is rotatably mounted with respect to the body. In the preferred embodiment the generally spherical puck element has a greater weight than the weight of the body.

The body includes an inner member within which the generally spherical puck element is secured and a radially outwardly disposed ring secured to the exterior of the inner body. A pair of retainers are disposed on the upper and lower sides of the puck.

The generally spherical puck element preferably has a greater diameter than the distance between the upper and lower faces of the puck to facilitate converting of sliding friction of a conventional puck into rolling friction of the single spherical element. It is preferred to provide primary contact between the puck and the surface on which the puck is moving by contact between the generally spherical puck element and the underlying surface over which the puck is moving. The puck body is supported on the single spherical element.

The puck may be provided with openings to receive weight-adjusting means and may be generally of the size of a conventional puck.

It is an object of the present invention to provide a hockey puck which has improved kinetic energy maintaining characteristics so as to facilitate movement in a straight translational line with minimum or no deviation being caused by irregularities of the surface on which the puck is moving and increased distance of travel.

It is another object of the present invention to provide such a puck which may be employed on a wide variety of indoor surfaces, including natural or man-made ice, low friction resinous materials, wood, concrete, asphalt and other materials whereon hockey or hockey-like games may be played or practiced.

It is a further object of the invention to provide a puck which minimizes the extent to which puck movement over an irregular surface will result in undesired redirection of the puck.

It is a further object of the present invention to provide such a puck which is safe, durable, economical to manufacture and may be employed in a conventional manner in playing a game of hockey regardless of the surface on which the game is played.

It is an object of the present invention in one embodiment to provide a puck which performs on a surface other than ice more like an ice hockey puck on ice than other non-ice hockey pucks employed for such surfaces.

These and other objects of the invention will be more fully understood from the following description on reference to the illustrations appended hereto.

DESCRIPTION OF THE PREFERRED EMBODIMENT

Referring to FIGS. 1–4, the puck has a generally spherical puck element 2 and a puck body 4. The generally spherical puck element 2 is preferably centered on the axis A of the puck.

Figure 1:
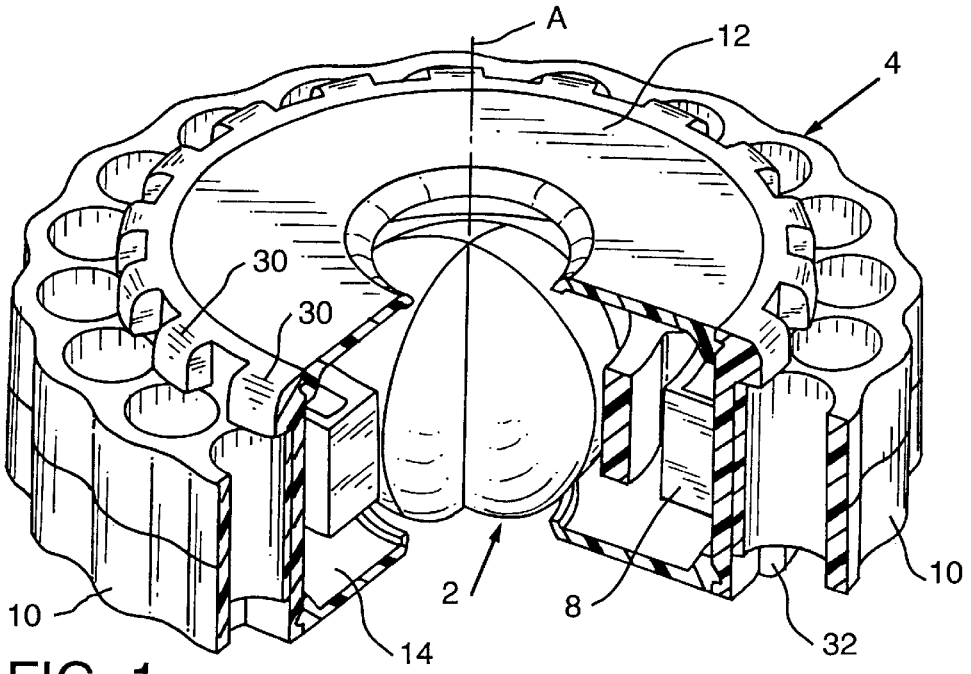
FIG. 1 is a partially broken-away perspective view of one form of hockey puck of the present invention.

The puck body has an annular inner member 8, a radially outwardly disposed ring member 10 and a pair of retainers 12, 14. In the form shown, the ring 10 is disposed radially outwardly of the inner member 8 and has a central opening 31 and an undulating outer surface 18 as well as a plurality of generally parallel through bores 20, 22. The ring is preferably composed of a resiliently compressible material, such as rubber or a soft resinous plastic. The compressibility of the material coupled with the presence of the bores 20, 22 serve to reduce weight and facilitate ring compression response to impact. This allows longer contact time with the stick and provides enhanced stick/puck friction to facilitate desired rotational forces. In the form shown, the outer surface of the ring has undulations. The undulations facilitate energy absorption for enhanced player safety and provides for weight savings. If desired, a smooth ring wall may be employed. In the form shown, the outer surface 28 of the inner member 8 has an upper row of spaced outwardly projecting detents, such as 30, and a lower row of circumferentially spaced outwardly projecting detents 32 with the ring 10 being received therebetween as shown in FIG. 1 to effect intimate interengagement between the ring 10 and the inner member 8. The outer ring 10, therefore, is firmly secured within recess 28 of the inner member 8.

Figure 2:
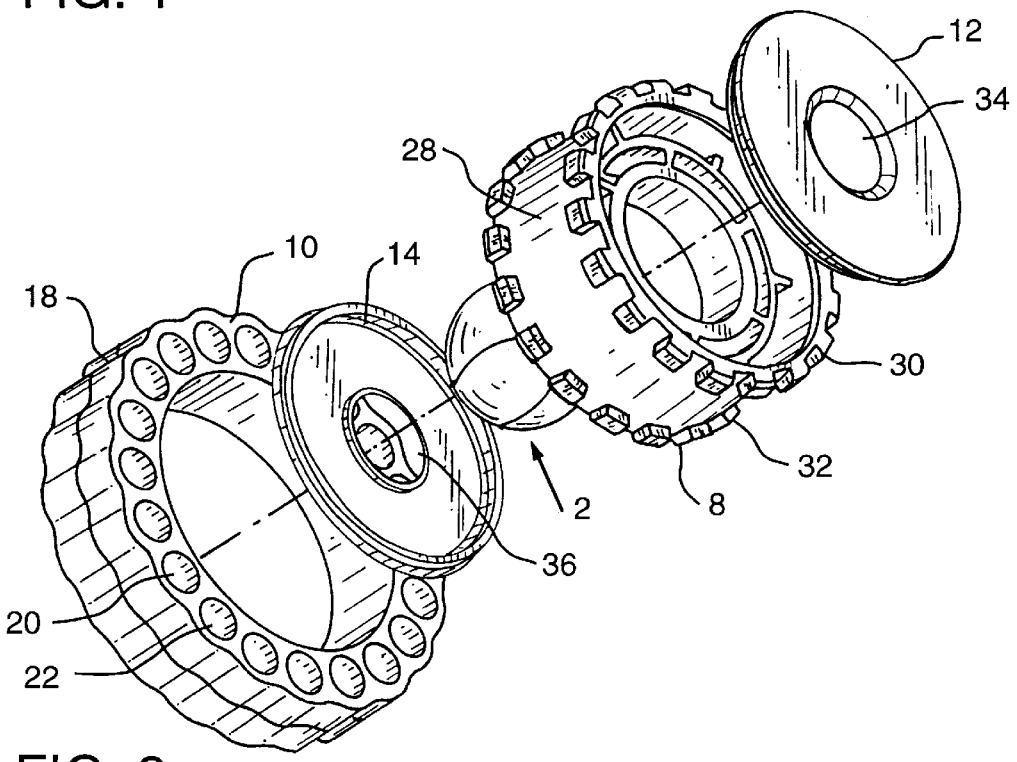
FIG. 2 is an exploded view of the puck of FIG. 1.
Figure 3:
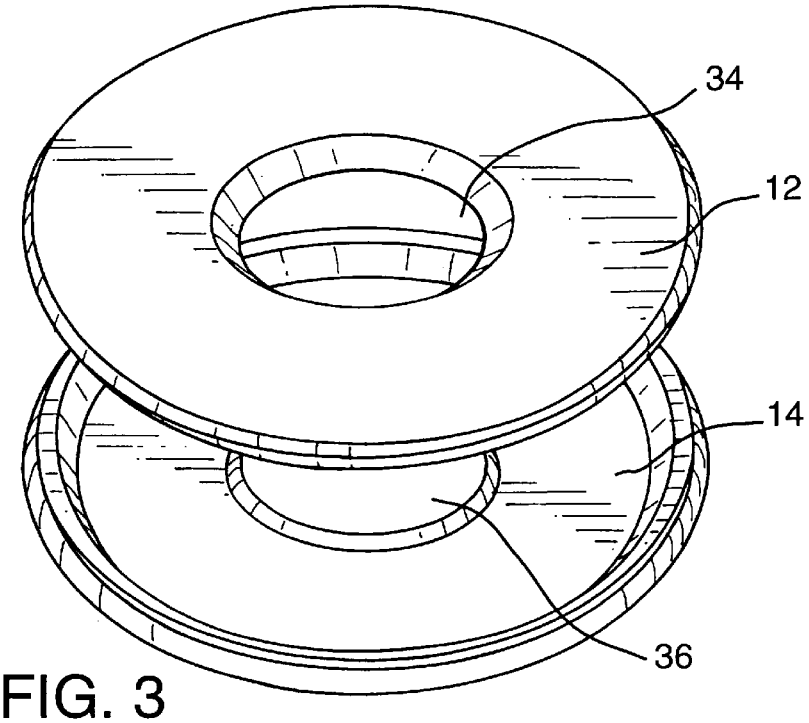
FIG. 3 is an exploded view showing a pair of retainer members such as that used in the embodiment of FIG. 1.
Figure 4:
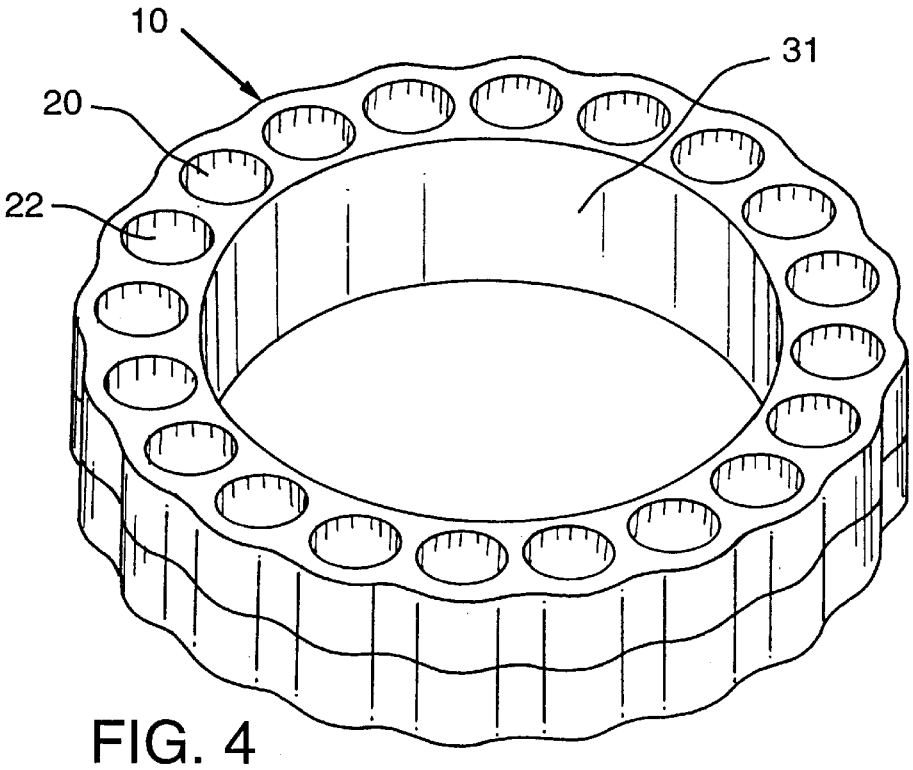
FIG. 4 is a perspective view of the ring shown in FIG. 1.

With reference to FIGS. 1–3, the retainers 12, 14 will be considered in greater detail. Retainer 12 has a central opening 34 and retainer 14 has a central opening 36. The openings as so sized as to permit a portion of the generally spherical puck element 2 to project therethrough and contact the surface on which the puck is supported. The openings 34, 36 are, in the form shown, circular and are not sufficiently large to allow the generally spherical puck element 2 to pass completely therethrough.

It will be appreciated that in the preferred embodiment only a single ball-like generally spherical puck element 2 is provided in the puck and it is located in a generally co-axial position with respect to the central axis A of the puck. The puck body and generally spherical element 2 may be made of any material which provides the desired strength, durability and performance characteristics, such as resinous plastic, fiber reinforced plastic, rubber, metal, such as steel or aluminum, ceramics and combinations thereof. The body and generally spherical element need not be made of the same material.

In use the generally spherical puck segment is rotatable with respect to the body portion through the mounting of the generally spherical puck element 2 within the inner member 8 and the retainers 12 and 14. In the preferred embodiment, the generally spherical puck element 2 will have the greater diameter than the distances between the upper face and lower face defined by the upper and lower outer surfaces, respectively, of retainers 12 and 14. When the puck is in a stationary position, it will be supported on the generally spherical puck element 2 or the generally spherical puck element plus a small portion of the circumference of a lower portion of the body. As a result, when the puck is struck as by the blade of a hockey stick, it will be subjected to translational movement with or without rotational movement. In the preferred approach, the entire puck will translate and the generally spherical puck element 2 will translate and rotate. The generally spherical puck element 2 minimizes the frictional loss and converts what would with a conventional puck be substantial sliding friction to primarily or solely rolling friction. As a result of the minimal contacts and the nature of the kinetic energy, the puck will be more inclined to stay on course despite irregularities in the surface on which it is moving and contact with obstructions. Moments are reduced as the center of gravity is at or near the puck center.

Figure 5:
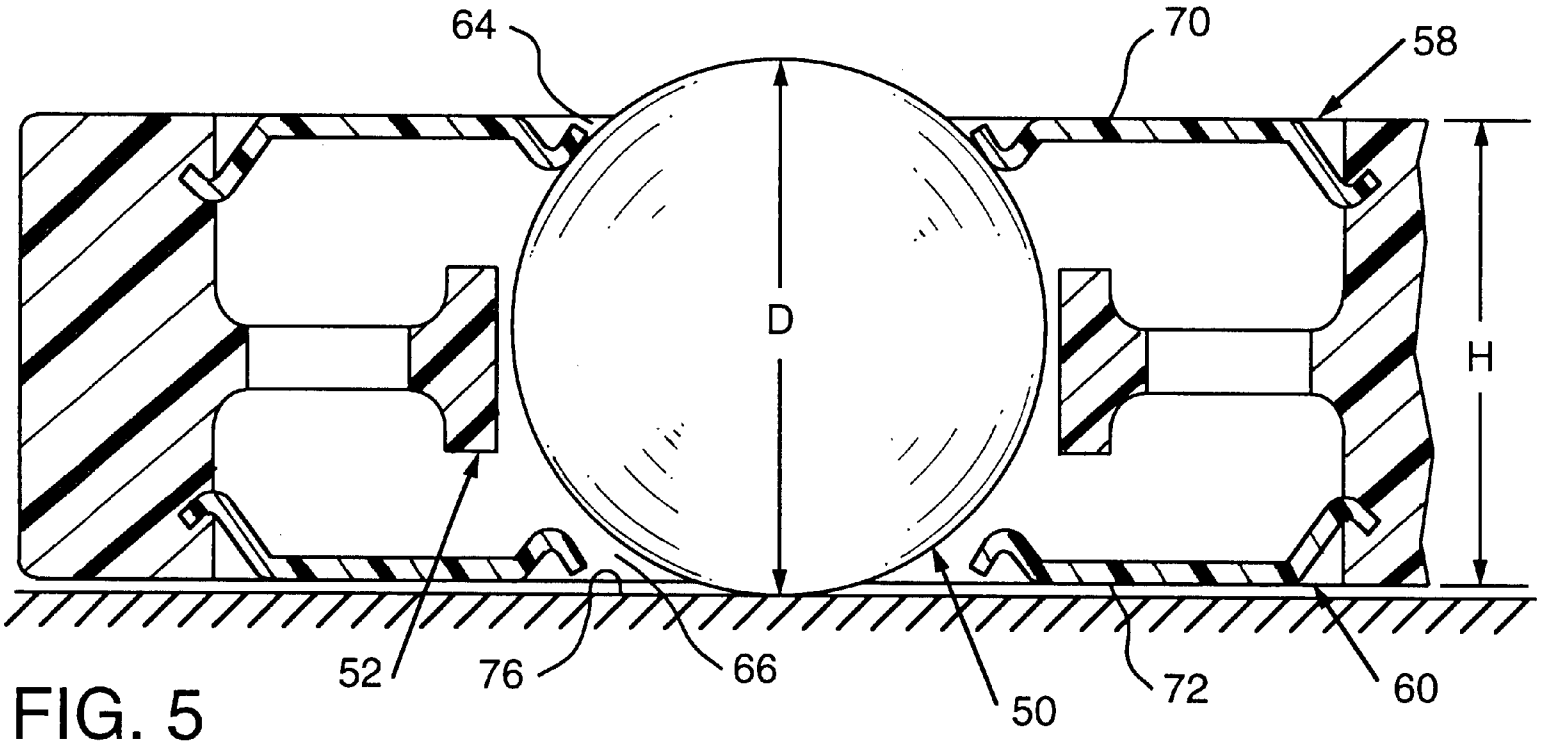
FIG. 5 is a cross-sectional illustration of a form of puck of the present invention.

Referring to FIG. 5, which shows schematically a generally spherical puck element 50 which has a diameter D and a schematically illustrated annular inner member 52 with respect to which the spherical element 50 is rotatably mounted. Annular retainers 58, 60 have openings 64, 66 respectively. It is preferred that the puck body height H measured from the upper surface 70 of retainer 58 to the lower surface 72 of retainer 60 be about 0.9 to 1.1 inch and that the puck body have an average outer diameter of about 2⅞ to 3¹⁄₁₆ inch. It is preferred that the diameter D of the generally spherical puck element 50 be greater than height H and preferably be greater by about 10 to 25 percent. This permits the spherical puck element 50 when supported on a surface, such as 76, to project upwardly through opening 64. The size of opening 64, or if the puck were inverted 66, results in the puck body being supported in spaced relationship with respect to underlying surface 76 as a result of the relative size of opening 64 and the diameter of the spherical puck element 50. The upper retainer 58 will be supported on spherical puck element 50 which, in form, lifts the puck body off of underlying surface 76. This produces primary contact between the puck and the underlying surface 76 through generally spherical puck element 50 and thereby provides the desired degree of freedom of movement. In the preferred embodiment the mass of the generally spherical puck element 50 is greater than the mass of the body of the puck and the generally spherical puck element 50 is positioned at the center of gravity of the puck.

The generally spherical puck element 2, 50 may be made of any suitable material which is preferably substantially rigid. Among the suitable materials are rubber, resinous plastic, ceramics or a metal, such as aluminum or steel. Also, the inner member 8 and retainers 12, 14 may be composed of the materials selected from the same group and are preferably substantially rigid. In general, the ring 10 will be composed of a resiliently compressible material, such as rubber, or a resinous plastic.

Figure 6:
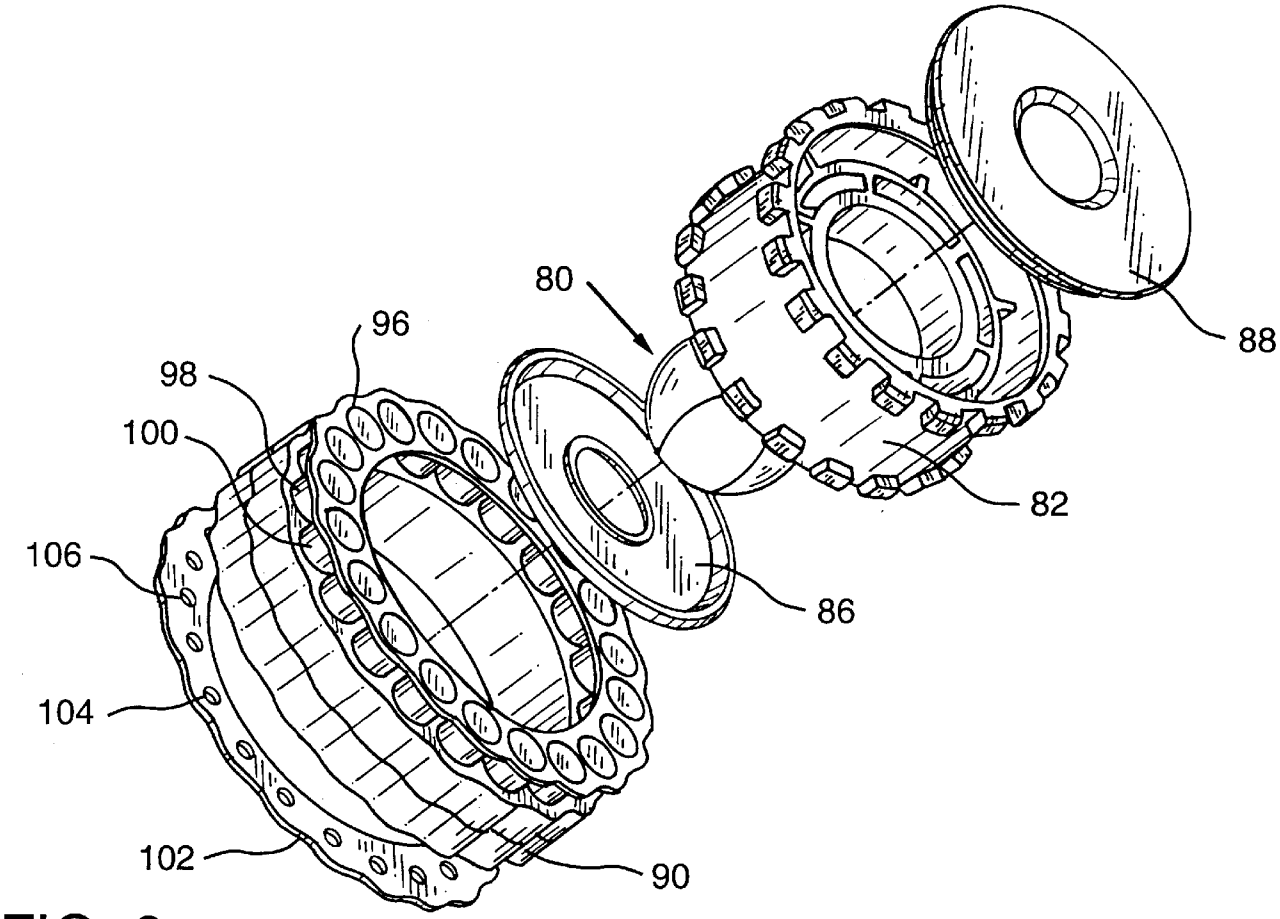
FIG. 6 is an exploded view of a modified version of puck of the present invention.

Referring to FIG. 6, another embodiment of the invention will be considered. In this embodiment, a generally spherical puck element 80 is rotatably received within an inner element 82 between retainers 86, 88 with the ring 90 being mechanically interengaged with the annular inner member 82 and the retainers 86, 88. In this embodiment, in order to alter the weight of the puck or the impact characteristics, an annular weighted retainer member 96 has a plurality of downwardly projecting cylindrical elements, such as 98, 100, which are received within openings such as those designated by the reference numbers 20 and 22 in FIG. 4 with a lower ring 102 having openings, such as 104, 106, through which mechanical fasteners, such as screws, rivets or snaps, for example, may pass to secure the annular weighted member 96 to the ring 90. In the alternative, a snap fit between cylinders, such as 98, 100, and recesses, such as 20, 22, may be provided with lower ring 102 eliminated. As a further alternative, the rows of detents, such as 83, 85, could be employed to secure retainer member 96 in place with ring 102 not being required. Retainer member 96 will serve to permit adjustment in the weight and impact characteristics of the puck to the desired amount without altering the exterior appearance or mechanical functioning of the puck. Retainer member 96 also serves to stiffen outer ring 90. As an alternative, the generally spherical puck element 80 may be hollow. This would facilitate placing weight within the ball to either increase the mass of the ball in addition to or in lieu of the use of an annular member, such as 96.

Figure 7:
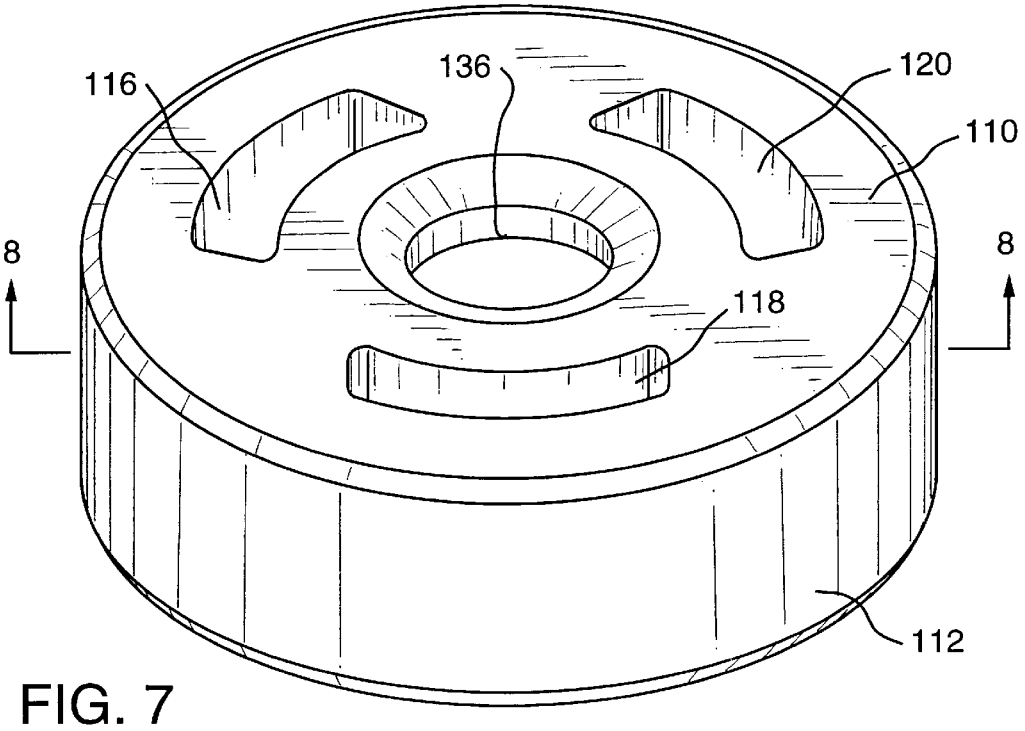
FIG. 7 is a perspective view of a further embodiment of the puck of the present invention.
Figure 8:
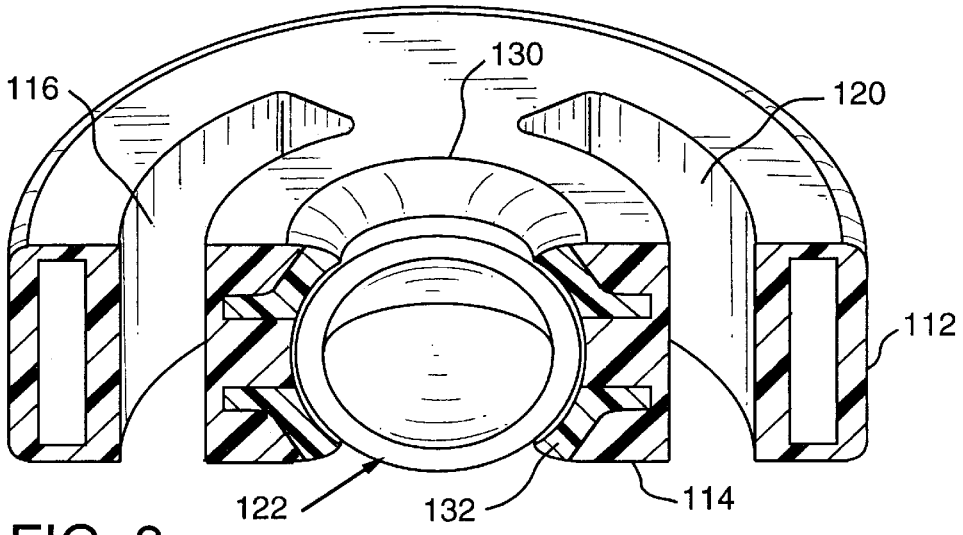
FIG. 8 is a cross-sectional illustration of the puck of FIG. 7 taken through 8—8.
Figure 9:
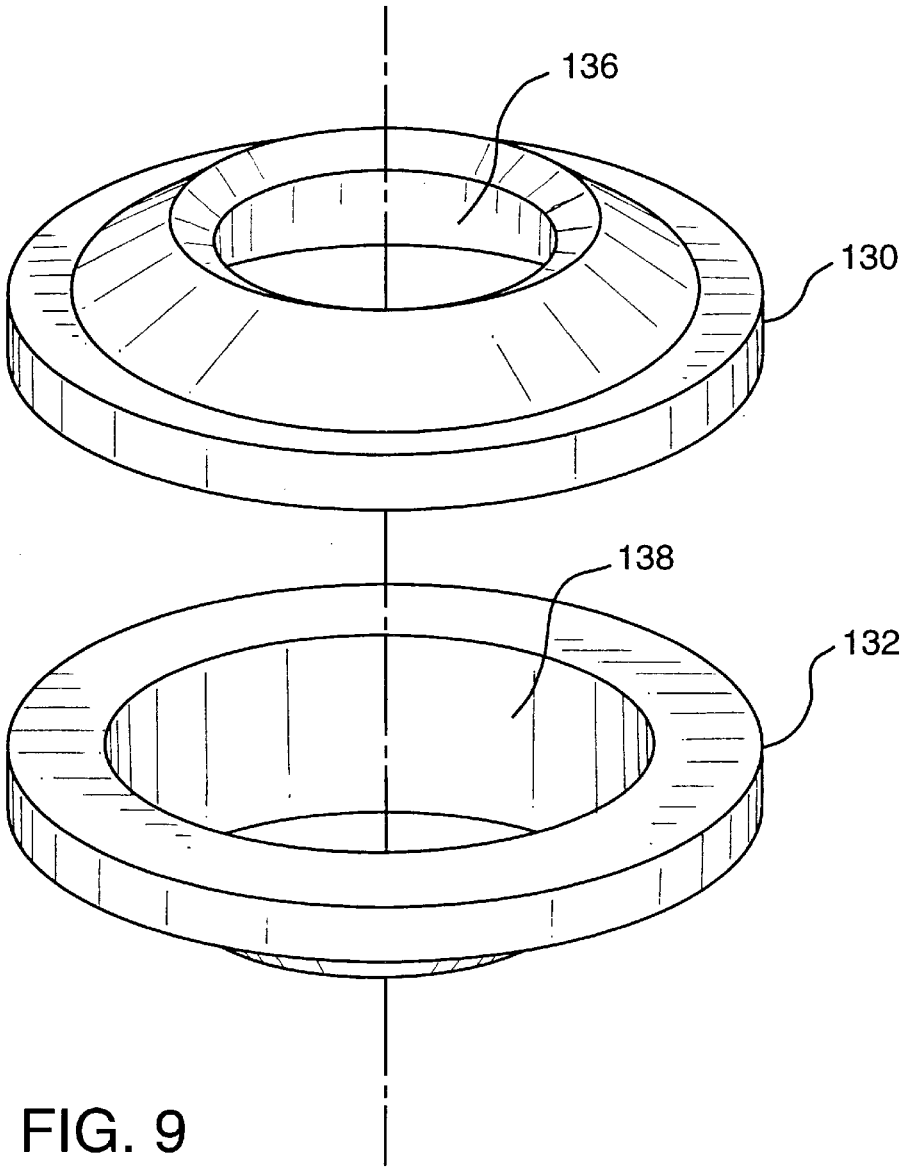
FIG. 9 an exploded view of a form of a pair of retainers of the type usable in the embodiment of FIGS. 7 and 8.

Referring to FIGS. 7 through 9, another embodiment of the invention will be considered. In this embodiment, the puck body may be injection molded around the retaining rings and generally spherical puck element. In this embodiment, a puck has an upper face 110, a smooth circumferential wall 112, and a lower face 114 (not fully illustrated). A central axial opening 136 retains a generally spherical puck element 122 which, in the form shown, has a hollow interior 131. This embodiment has a plurality of openings 116, 118, 120 which extend generally circumferentially at a position radially outward of central puck opening 130 and radially inward of the circumferential wall 112. These openings 116, 118, 120 produce reduction in puck weight. In the form shown, the openings 116, 118, 120 pass completely through the puck from upper surface 110 to lower surface 114. Retainers 130, 132 are secured within the upper and lower portions of opening 120 and provide openings 136, 138, respectively, for allowing the generally spherical puck element to extend therethrough. These are preferably injection molded in place. If desired, the puck can be molded in halves with each half being molded around a retainer 130, 132, and the halves being joined around the generally spherical puck element 122 by thermal welding or mechanical fasteners.

It will be noted also, that the mechanical interengagement of the components of the puck serve to resist undesired entry of foreign matter into the interface between the generally spherical puck element and the puck body, thereby providing more consistent durable performance.

It will be appreciated, therefore, that the present invention provides an improved hockey puck which serves to resist undesired departures from a straight translational path resulting from irregularities in the surface over which the puck is moving or impact with other objects. The design having a single generally centrally located generally spherical puck element which has a mass greater than the puck body, and is rotatably mounted with respect thereto, minimizes the amount of frictional forces retarding movement of the puck and serves to convert what would normally be sliding friction into rolling friction. The dimensioning and mass of the generally spherical puck element, as well as the mechanics of its functioning, all contribute to the enhanced performance. All of this accomplished without requiring any significant alteration in the manner in which the game is played regardless of what surface it is played on.

Whereas, particular embodiments of the present invention have been described herein for purposes of illustration, it will be appreciated by those skilled in the art that numerous variations of the details may be made without departing from the invention as described in the appended claims.

We claim:

1. A hockey puck comprising:

a generally cylindrical body having an upper face, a lower face, and a circumferential wall, a generally spherical puck element disposed centrally within said body, said generally spherical puck element being rotatable and translatable with respect to said body, said generally spherical puck element having a weight greater than the weight of said puck body, and said body including an inner member within which said generally spherical puck element is disposed, a ring disposed radially outwardly of said inner member and a pair of retainers disposed on opposite sides of said inner member for rotatably securing said generally spherical puck element to said puck body.

2. The hockey puck of claim 1 including said retainers having openings through which said generally spherical puck element can project.

3. The hockey puck of claim 2 including said puck body having a height measured from the exterior of said upper face to the exterior of said lower face of about 0.9 to 1.1 inch.

4. The hockey puck of claim 3 including said generally spherical puck element having a diameter of about 10 to 25 percent greater than the puck height.

5. The hockey puck of claim 1 including said puck ring having an irregularly configurated exterior surface.

6. The hockey puck of claim 1 including said retainers being in mechanical interengagement with said inner member.

7. The hockey puck of claim 1 including said ring having a plurality of circumferentially spaced openings, and insert means for increasing the weight of said puck disposed within at least some of said openings.

8. The hockey puck of claim 1 including said generally spherical puck element having a diameter greater than the distance between said upper face and said lower face.

9. The hockey puck of claim 8 including said generally spherical puck element being composed of a material selected from the group consisting of a resinous plastic, steel, aluminum, and ceramics.

10. The hockey puck of claim 9 including said ring being composed of a resiliently compressible material.

11. The hockey puck of claim 10 including said pair of retainers being substantially rigid.

12. The hockey puck of claim 11 including said inner member being substantially rigid.

13. The hockey puck of claim 9 including said generally spherical puck element being substantially rigid.

14. A hockey puck comprising:

a generally cylindrical body having an upper face, a lower face, and a circumferential wall, a generally spherical puck element disposed centrally within said body, said generally spherical puck element being rotatable and translatable with respect to said body, said hockey puck having at least one opening extending between said upper face and said lower face, and said openings being disposed radially outwardly of said generally spherical puck element and radially inwardly of said circumferential wall.

15. A hockey puck comprising a generally cylindrical body having an upper face, a lower face, and a circumferential wall, a generally spherical puck element disposed centrally within said body, said generally spherical puck element being rotatable and translatable with respect to said body, weight-increasing means secured to said body, said weight-increasing means including an annular member to which a plurality of downwardly depending cylinders are secured, and said cylinders extending into bores formed within said annular ring.

16. A hockey puck comprising a generally cylindrical body having an upper face, a lower face, and a circumferential wall, a generally spherical puck element disposed centrally within said body, said generally spherical puck element being rotatable and translatable with respect to said body, and said puck body having a pair of retainers disposed adjacent to said generally spherical puck element and a molded resinous material securing said retainers in position.

17. The hockey puck of claim 16 including said molded resinous material being injection molded and securing said retainers adjacent to said generally spherical puck element while permitting rotation thereof.

* * * * *